US011879225B2

(12) United States Patent
DeWind et al.

(10) Patent No.: US 11,879,225 B2
(45) Date of Patent: Jan. 23, 2024

(54) FLEXIBLE IN-GROUND SHIELD APPARATUS

(71) Applicant: One Pass Innovators, LLC, Zeeland, MI (US)

(72) Inventors: Ryan DeWind, Zeeland, MI (US); Gregory Allen DeWind, Zeeland, MI (US)

(73) Assignee: One Pass Innovators, LLC, Zeeland, MI (US)

( * ) Notice: Subject to any disclaimer, the term of this patent is extended or adjusted under 35 U.S.C. 154(b) by 0 days.

(21) Appl. No.: 17/558,528

(22) Filed: Dec. 21, 2021

(65) Prior Publication Data

US 2022/0195684 A1 Jun. 23, 2022

Related U.S. Application Data

(60) Provisional application No. 63/128,638, filed on Dec. 21, 2020.

(51) Int. Cl.
*E02D 17/08* (2006.01)
*E02F 5/10* (2006.01)

(52) U.S. Cl.
CPC ..... *E02D 17/086* (2013.01); *E02F 5/10* (2013.01)

(58) Field of Classification Search
CPC ..... E02D 17/086; E02D 17/08; E02D 17/04; E02F 5/10
See application file for complete search history.

(56) References Cited

U.S. PATENT DOCUMENTS 4,741,646 A * 5/1988 Hatch ..... E02F 5/145 405/175
5,193,938 A * 3/1993 Akesaka ..... E02F 5/10 405/184.5
2007/0177945 A1* 8/2007 Paull ..... E02F 5/101 405/174
2013/0019561 A1* 1/2013 Andras ..... E03F 5/22 137/362
2014/0248093 A1* 9/2014 Breen ..... E02F 5/10 405/284
2016/0108599 A1* 4/2016 Spry ..... E02D 17/08 405/282

FOREIGN PATENT DOCUMENTS

KR 20090119504 * 11/2009

* cited by examiner

*Primary Examiner* — Sean D Andrish
(74) *Attorney, Agent, or Firm* — The Watson IP Group, PLC; Jovan N. Jovanovic

(57) ABSTRACT

A flexible in-ground shield includes a first wall, a second wall, a third wall, a plurality of shoring members, and a plurality of pivoting couplers. The first wall is disposed on a first side of the flexible in-ground shield, the second wall is disposed on a second side of the flexible in-ground shield, and the third wall is disposed on a third side of the flexible in-ground shield and coupled to the first and second walls. The plurality of shoring members extend between the first wall and the second wall, and the plurality of pivoting couplers, coupled to ends of the plurality of shoring members, respectively, allow the first wall and the second wall to pivot relative to the third wall.

15 Claims, 9 Drawing Sheets

FLEXIBLE IN-GROUND SHIELD APPARATUS

CROSS-REFERENCE TO RELATED APPLICATION

This application claims priority from U.S. Provisional Patent Application Ser. No. 63/128,638 filed on Dec. 21, 2020, entitled "FLEXIBLE IN-GROUND SHIELD APPARATUS", the entire disclosure of which is hereby incorporated by reference in its entirety.

BACKGROUND OF THE DISCLOSURE

1. Field of the Disclosure

The disclosure relates in general to a shield apparatus, and more particularly, to a flexible in-ground shield apparatus.

2. Background Art

In-ground systems are used for a variety of purposes, such in-ground systems include in-ground trenches and walls. These in-ground systems can include ground fluid and product recovery trenches, seepage trenches/collection trenches, slurry walls and cement walls, permeable reactive barriers/full and gate systems, High Density Poly Ethylene (HDPE) barrier walls, underground alluvial fluid storage reservoir containment walls, cement footing foundations and "formless walls", etc. Large scale industrial trenchers have been developed that are able to dig trenches that are extremely deep (e.g., up to 125' feet below grade), these trenches being used to form such in-ground trenches and walls.

SUMMARY OF THE DISCLOSURE

The disclosure is directed to a flexible in-ground shield comprising a first wall, a second wall, a third wall, a plurality of shoring members, and a plurality of pivoting couplers. The first wall is disposed on a first side of the flexible in-ground shield, the second wall is disposed on a second side of the flexible in-ground shield, and the third wall is disposed on a third side of the flexible in-ground shield and coupled to the first and second walls. The plurality of shoring members extend between the first wall and the second wall, and the plurality of pivoting couplers, coupled to ends of the plurality of shoring members, respectively, allow the first wall and the second wall to pivot relative to the third wall.

In some configurations, the plurality of pivoting couplers are at least one of a hinge joint, a ball and socket joint, a condyloid joint, and a saddle joint.

In some configurations, the flexible in-ground shield further comprises a pivoting flap, disposed on a leading edge of a bottom of the flexible in-ground shield, to prevent dirt from entering the flexible in-ground shield at the leading edge during use.

In some configurations, the first and second walls taper from a greater width proximate a top of the flexible in-ground shield to a lesser width proximate to a bottom of the flexible in-ground shield.

In some configurations, wherein a top of the flexible in-ground shield receives fill material to fill a trench formed by a trencher that the flexible in-ground shield is coupled to.

In some configurations, the top of the flexible in-ground shield receives the fill material via a conveyor coupled to the trencher.

In some configurations, the fill material is disposed into a rear hopper coupled to a rear of the trencher.

In some configurations, the flexible in-ground shield further comprises a flexible pipe tubular guide, disposed between the first, second, and third walls, to guide a flexible pipe toward a bottom of the flexible in-ground shield.

In some configurations, the flexible in-ground shield further comprises a release post, disposed on at least one of the first and second walls, to couple the flexible in-ground shield to a trencher chain mechanism via a release hook.

In some configurations, the flexible in-ground shield further comprises a fill material guide member coupled to the first, second, and third walls. The fill material guide member is angled to taper an area between the third wall and a front of the flexible in-ground shield from a greater area proximate to a top of the flexible in-ground shield to a lesser area proximate to a bottom of the flexible in-ground shield, the fill material guide member guiding a fill material disposed into the flexible in-ground shield to the lesser area.

In some configurations, the flexible in-ground shield further comprises a trencher coupler disposed proximate to a top of the flexible in-ground shield, the trencher coupler coupling the flexible in-ground shield to a trencher.

In some configurations, the third wall is recessively coupled to the first and second walls to form a channel therebetween, the channel being disposed on a back of the flexible in-ground shield.

In some configurations, the flexible in-ground shield further comprising a flexible pipe curved guide including a curved surface to redirect a direction of travel of a flexible pipe.

In some configurations, a system includes the flexible in-ground shield, and the system further comprises a trencher.

In some configurations, the system further comprises a sump apparatus, the sump apparatus including a sump shielding dimensioned to allow the sump shielding to be disposed between the first and second walls.

In some configurations, a cable is coupled proximate to a bottom of the sump apparatus and is used to release the sump apparatus from the flexible in-ground shield.

In some configurations, the flexible in-ground shield further comprises a hopper coupled a top of the flexible in-ground shield.

BRIEF DESCRIPTION OF THE DRAWINGS

The disclosure will now be described with reference to the drawings wherein.

DETAILED DESCRIPTION OF THE DISCLOSURE

Figure 1:
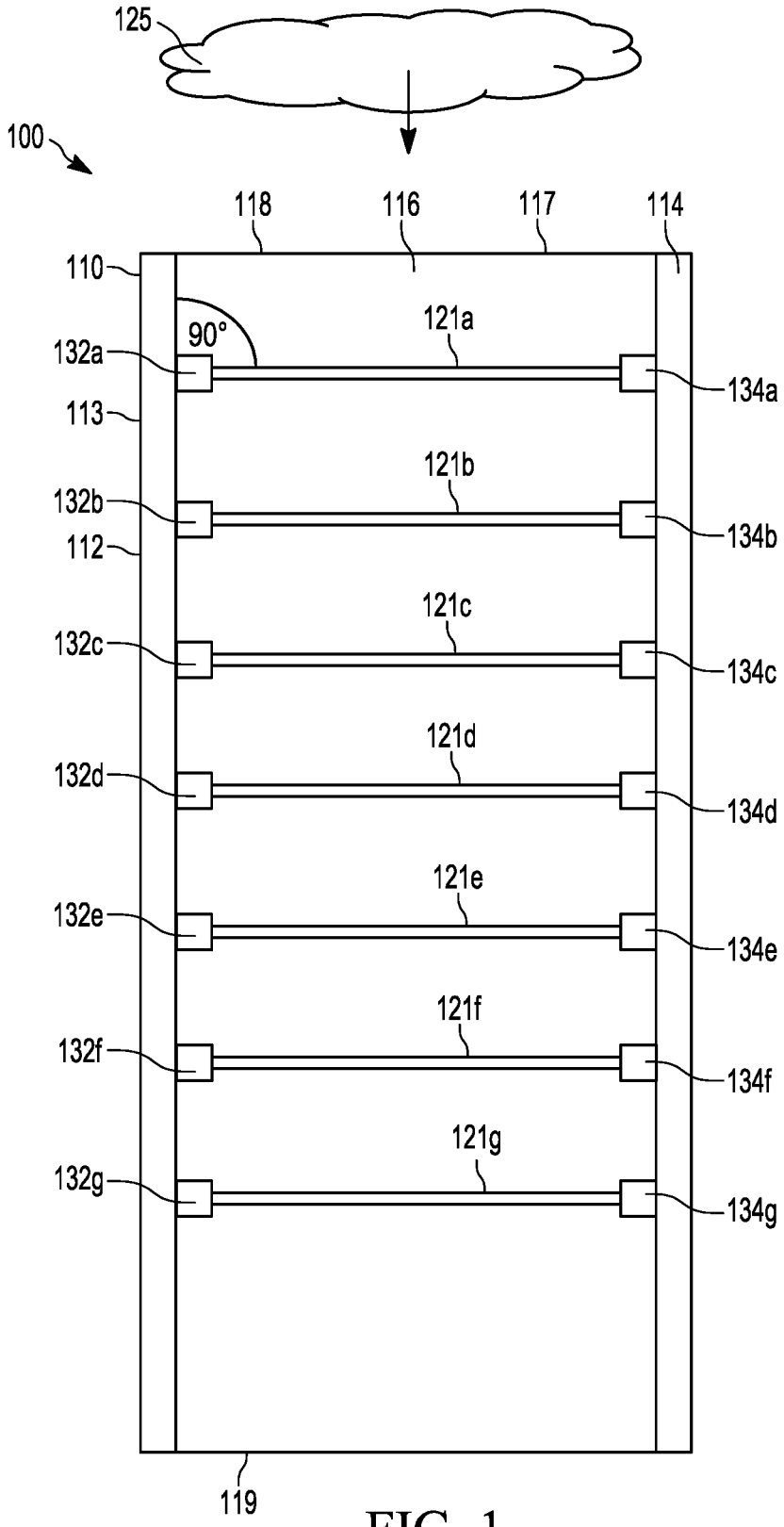
FIG. 1 illustrates a front view of an example flexible in-ground shield apparatus, in accordance with at least one embodiment disclosed herein.

While this disclosure is susceptible of embodiment(s) in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

It has become appreciated that typical in-ground shields based on existing shield technology have a deficiency. For example, when such typical in-ground shields experience forces on their side walls during excavation, particularly when such excavation entails excavation in a non-straight line such as an arc or curve, such forces can create cracks in their side walls. When that occurs, all work stops on the worksite while such cracks are repaired. Stopping any worksite is costly. At least one flexible in-ground shield is disclosed below that at least mitigates such a deficiency by allowing the shield to flex in response to such forces, thereby at least mitigating cracks associated with the typical in-ground shield.

Figure 8:
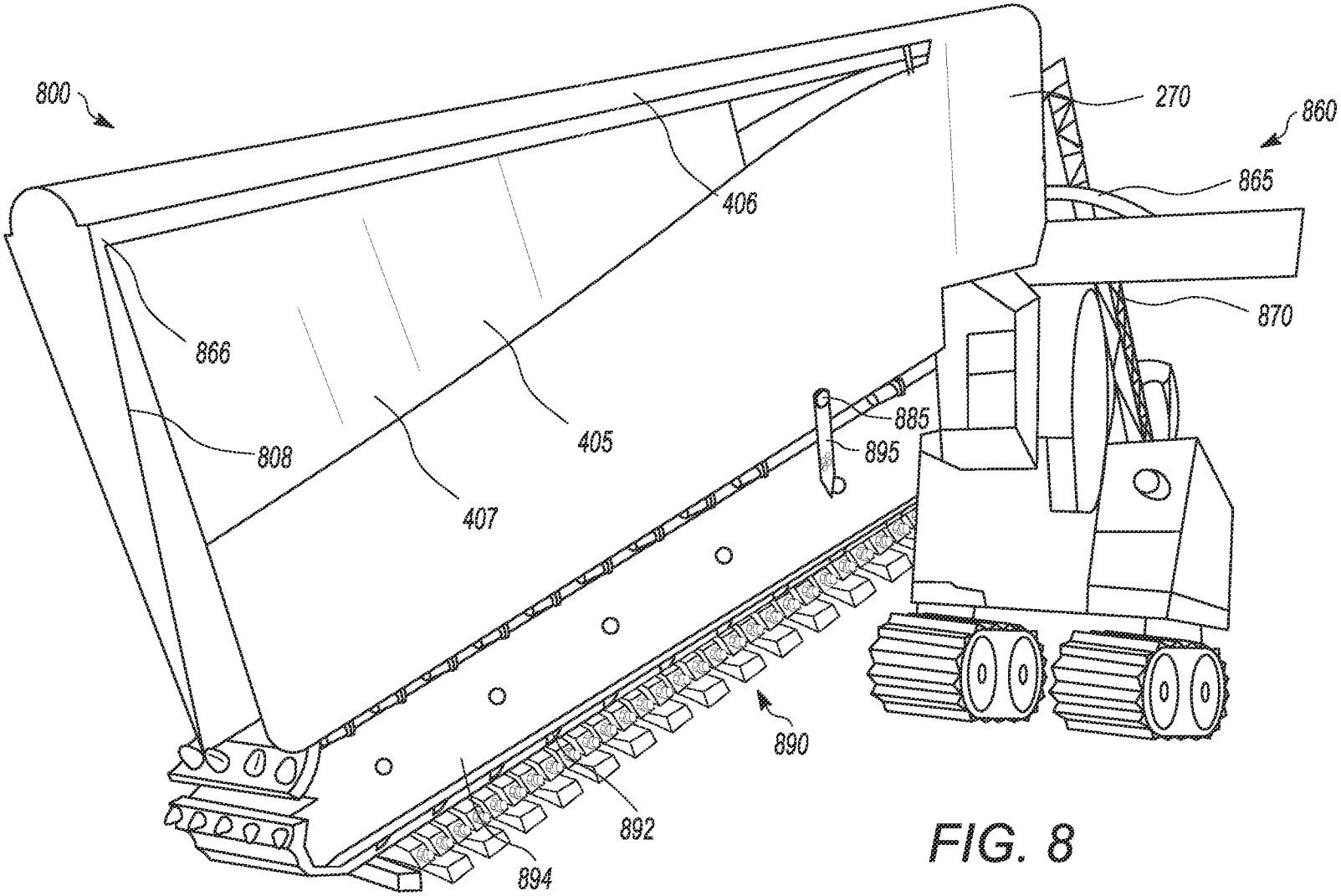
FIG. 8 illustrates an isometric view of an example system including the ground excavation shield shown in FIG. 2, in accordance with at least one embodiment disclosed herein.
Figure 9:
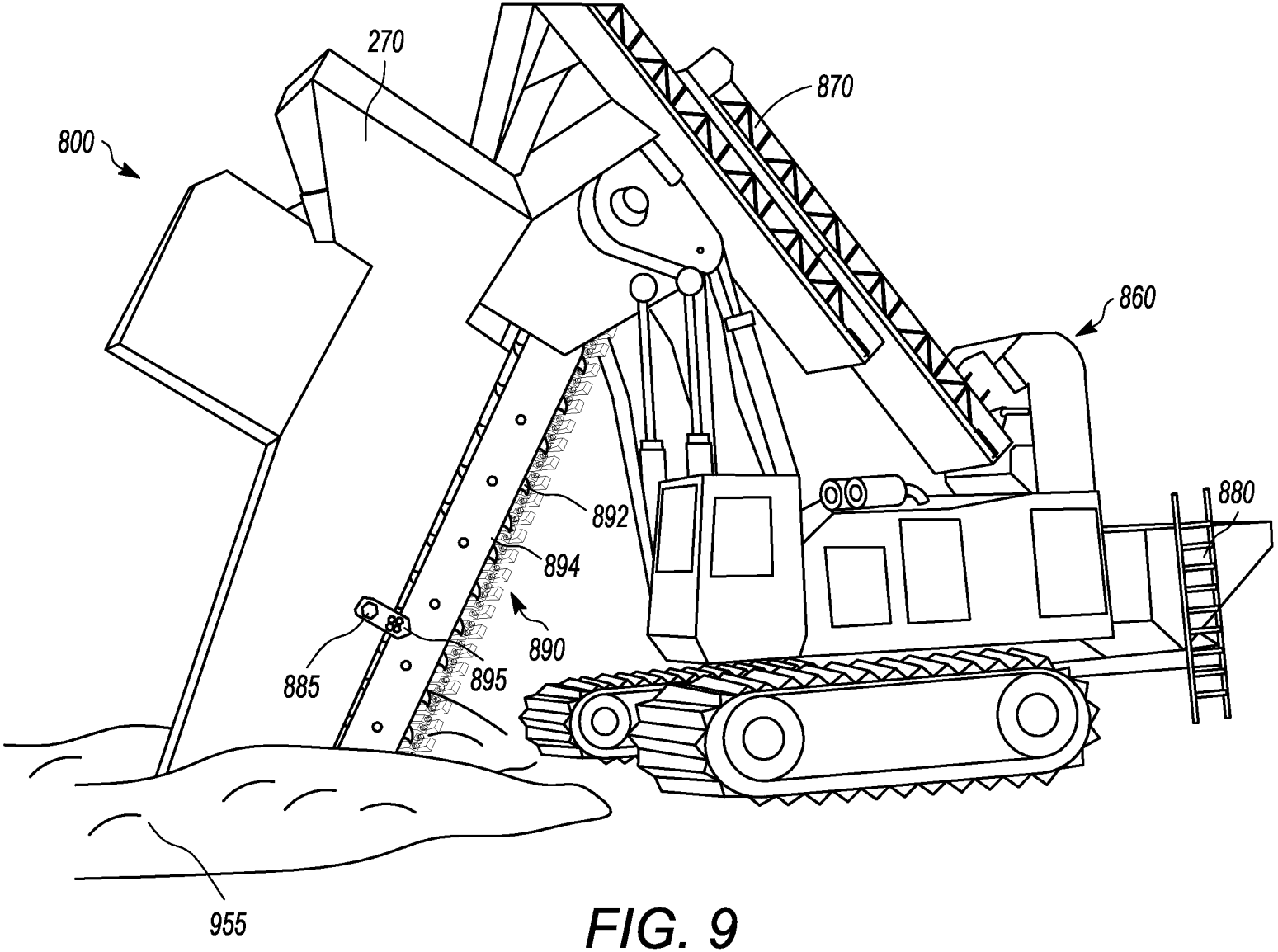
FIG. 9 illustrates another isometric view of the system shown in FIG. 8, in accordance with at least one embodiment disclosed herein.

Referring now to the drawings and in particular to FIG. 1, an apparatus is disclosed, such as a flexible in-ground shield 100. In at least one embodiment, the flexible in-ground shield 100 can be constructed from steel, aluminum, cast iron, concrete, or any other material that can withstand the forces associated with being used as an in-ground shield. The flexible in-ground shield 100 includes a first wall 112 disposed on a first side 113 of the flexible in-ground shield 110. The flexible in-ground shield 100 further includes a second wall 114 disposed on a second side 115 of the flexible in-ground shield 100. The flexible in-ground shield 100 even further includes a third wall 116 disposed on a third side 117 of the flexible in-ground shield 100, the third wall 116 being coupled to the first and second walls 112/114 at a perpendicular angle. A width of the third wall 116 can vary depending upon a width of a trench being dug by a trencher 860 (FIGS. 8 and 9). Likewise, the width of the first and second walls 212/214 can vary depending upon the amount of shielding desired for a particular worksite. The flexible in-ground shield 100 includes a top 118 and a bottom 119, the top 118 being a location at which, in at least one embodiment, another example flexible in-ground shield 200 (FIG. 2) receives fill material 125 to fill a trench 955 (FIG. 9) formed by a trencher 860 that the flexible in-ground shield 200 is coupled to.

In the example shown in FIG. 1, the first, second, and third walls 112/114/116 are coupled on edges thereof, as shown. However, in at least one other embodiment the first, second, and third walls 112/114/116 can be coupled at a location other than edges thereof. For example, as shown in FIGS. 3, 4, 7, and 8, the flexible in-ground shield 200 includes a third wall 216 that can be recessively coupled to a first wall 212 and a second wall 214, that is the third wall 216 is coupled a short distance (e.g., approximately (+−10%) 12 inches) from edges of the first wall 212 and the second wall 214, to form a channel 222 therebetween. This channel 222 is disposed on a back 231 of the flexible in-ground shield 200, as shown, to create a space between a trenching chain 892 (FIGS. 8 and 9) and the third wall 216 when the flexible in-ground shield 200 is coupled to the trencher 860, to create path for dirt/debris to travel through during use of the trencher 860. Also as shown in FIGS. 4, 8, and 9, in at least one embodiment the first and second walls 212/214 can taper from a greater width at the top 218 of the flexible in-ground shield 200 to a lesser width at the bottom 219 of the flexible in-ground shield 200.

The flexible in-ground shield 100 further includes a plurality of shoring members, such as shoring members 121*a-g*, that extend between the first wall 112 and the second wall 114. The shoring members 121*a-g* shore the structure of the flexible in-ground shield 100 in that they maintain a substantially (+−5%) constant distance between the first wall 112 and the second wall 114 when external forces, such as those applied by soil, are pushing on the first and second walls 112/114 during use. As shown, the first and second walls 112/114 are substantially perpendicularly (+−5%) coupled to the third wall 116, although other angles are possible without departing from the scope of the embodiment(s) disclosed.

The shoring members 121*a-g* can be pipes (e.g., solid pipes, hollow pipes, internally webbed pipes, etc.), beams (boxed beams, I-beams, H-beams, T-beams, L-beams, C-beams, etc.), rods, a combination of different types of beams, or any other type of members that are able to withstand the compressive forces exerted on the beams. Although seven (7) shoring members 121*a-g* are shown in the example flexible in-ground shield 100, one skilled in the art would understand that more or less shoring members 121 can be used depending upon a height of the flexible in-ground shield 100, without departing from the scope of the embodiment(s) disclosed.

The flexible in-ground shield 100 further includes a plurality of pivoting couplers, such as a plurality of pivoting couplers 132*a-g* and pivoting couplers 134*a-g*, that are coupled to opposite ends of the plurality of shoring members 121*a-g*, respectively, as shown. The plurality of pivoting couplers 132*a-g*/134*a-g* allow the first wall 112 and the second wall 114 to pivot relative to the third wall 116. This freedom to pivot, even by small amounts (+−10 degrees), relieves stresses on the first and second walls 112/114 during use that otherwise could cause cracks in the first and second walls 112/114 when they typically are unable to pivot relative to the third wall 116 due to use of fixed/non-pivoting shoring members (not shown). In at least one embodiment, the plurality of pivoting couplers 132*a-g*/134*a-g* are at least one of a hinge joint, a ball and socket joint, a condyloid joint, a saddle joint, a combination of these, or any other pivoting coupler that allow the first and second walls 112/114 to pivot relative to the third wall 116. As shown with the flexible in-ground shield 200, a plurality of hinges 232/234 are used to couple shoring members 221 to the first and second walls 212/214, respectively.

Figure 2:
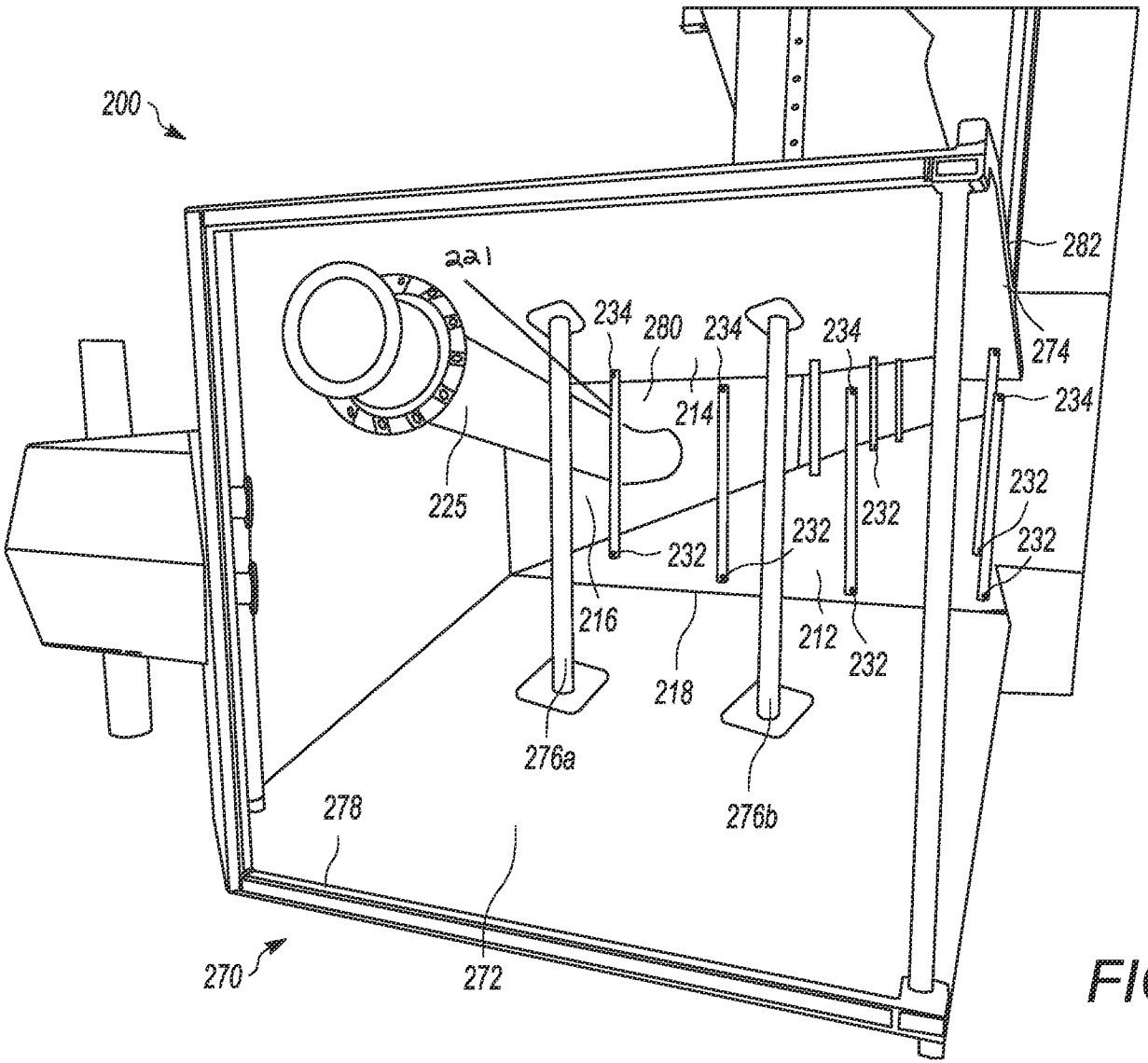
FIG. 2 illustrates an isometric top view of another example flexible in-ground shield apparatus, in accordance with at least one embodiment disclosed herein.

As shown in FIG. 2, the flexible in-ground shield 200 can further include a guide member, such as a flexible pipe tubular guide 225 disposed between the first, second, and third walls 212/214/216, the flexible pipe tubular guide 225 being a tube through which a flexible pipe 865 (FIG. 8) is guided toward a bottom 219 of the flexible in-ground shield 200, such as to a sump pipe 406 (FIGS. 4 and 8). In at least one embodiment, the flexible pipe tubular guide 225 can be coupled to the second wall 214 proximate to a top 218 of the flexible in-ground shield 200. In the example shown, the flexible pipe tubular guide 225 extends into the hopper 270.

In at least one embodiment, the flexible pipe tubular guide 225 is a first guide member and the flexible in-ground shield 200 includes a second guide member, such as a flexible pipe curved guide 450 (FIG. 4) that is disposed proximate to the bottom 219 of the flexible in-ground shield 200, receiving the flexible pipe 865, and redirecting a direction of travel of the flexible pipe 865 approximately (+−5 degrees) 90 degrees. In the example shown, the flexible pipe curved guide 450 can be approximately twice (+−10%) as wide as a width of the bottom 219 of the flexible in-ground shield 200, the flexible pipe curved guide 450 extending out from the flexible in-ground shield 200. In at least one embodiment, the flexible pipe curved guide 450 operates in conjunctions with the flexible pipe tubular guide 225 to redirect the flexible pipe 865 to the sump pipe 406.

Figure 6:
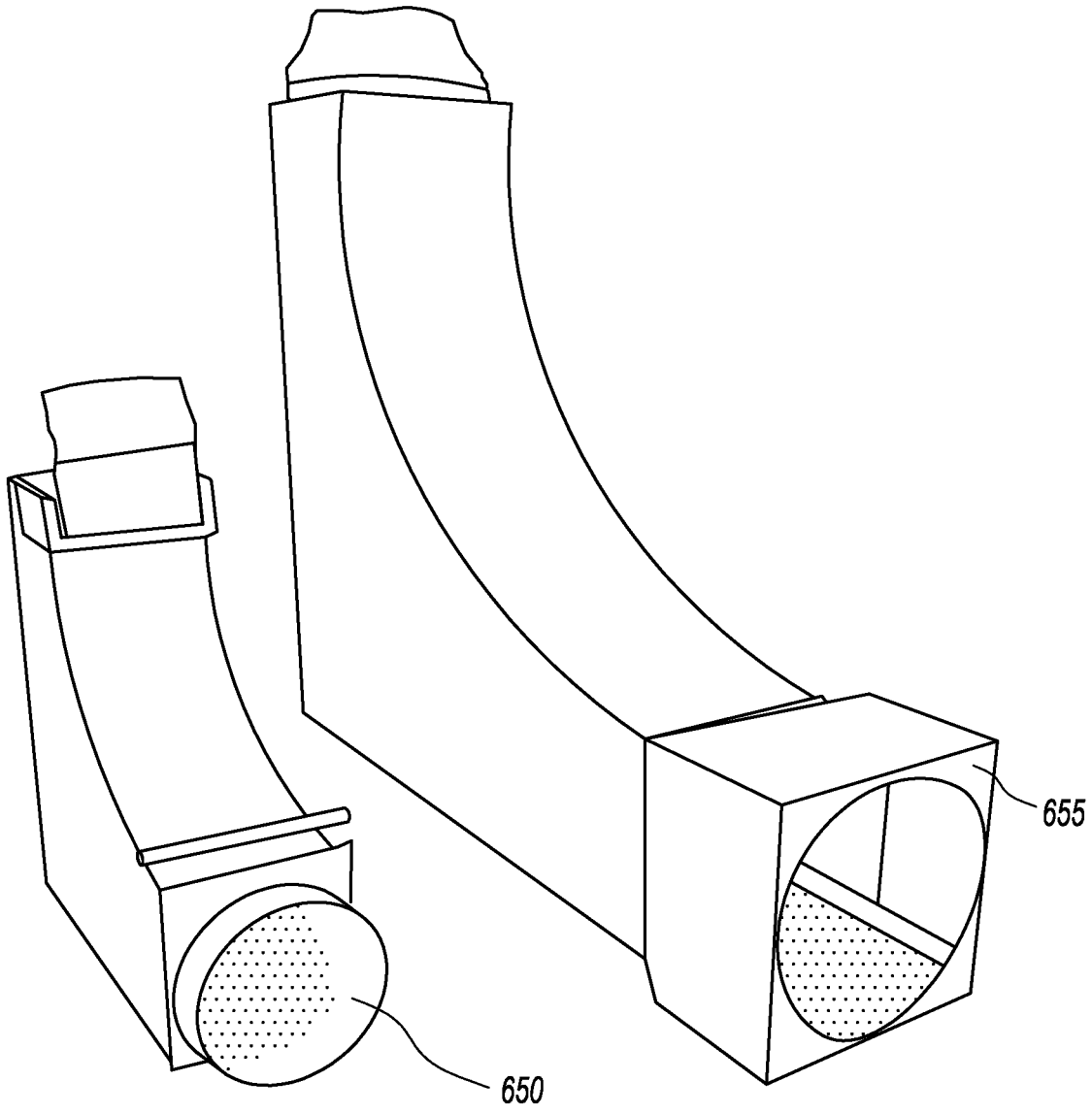
FIG. 6 illustrates an isometric bottom view of example flexible pipe curved guides, in accordance with at least one embodiment disclosed herein.

During operation, the flexible pipe 865 enters the flexible pipe tubular guide 225 and travels down a height of the flexible in-ground shield 200 into the ground to the flexible pipe curved guide 450. The flexible pipe 865 then follows a curved surface 452 of the flexible pipe curved guide 450 that redirects the flexible pipe 865 to an inlet 409 of the sump pipe 406. Depending upon the size of the flexible in-ground shield 200, the flexible pipe curved guide 450 can likewise vary in size. For example, as shown in FIG. 6 the flexible pipe curved guide 450 can vary in size significantly, with an example flexible pipe curved guide 650 being approximately (+−15%) half as large as an example flexible pipe curved guide 655 shown next to the flexible pipe curved guide 650.

Figure 3:
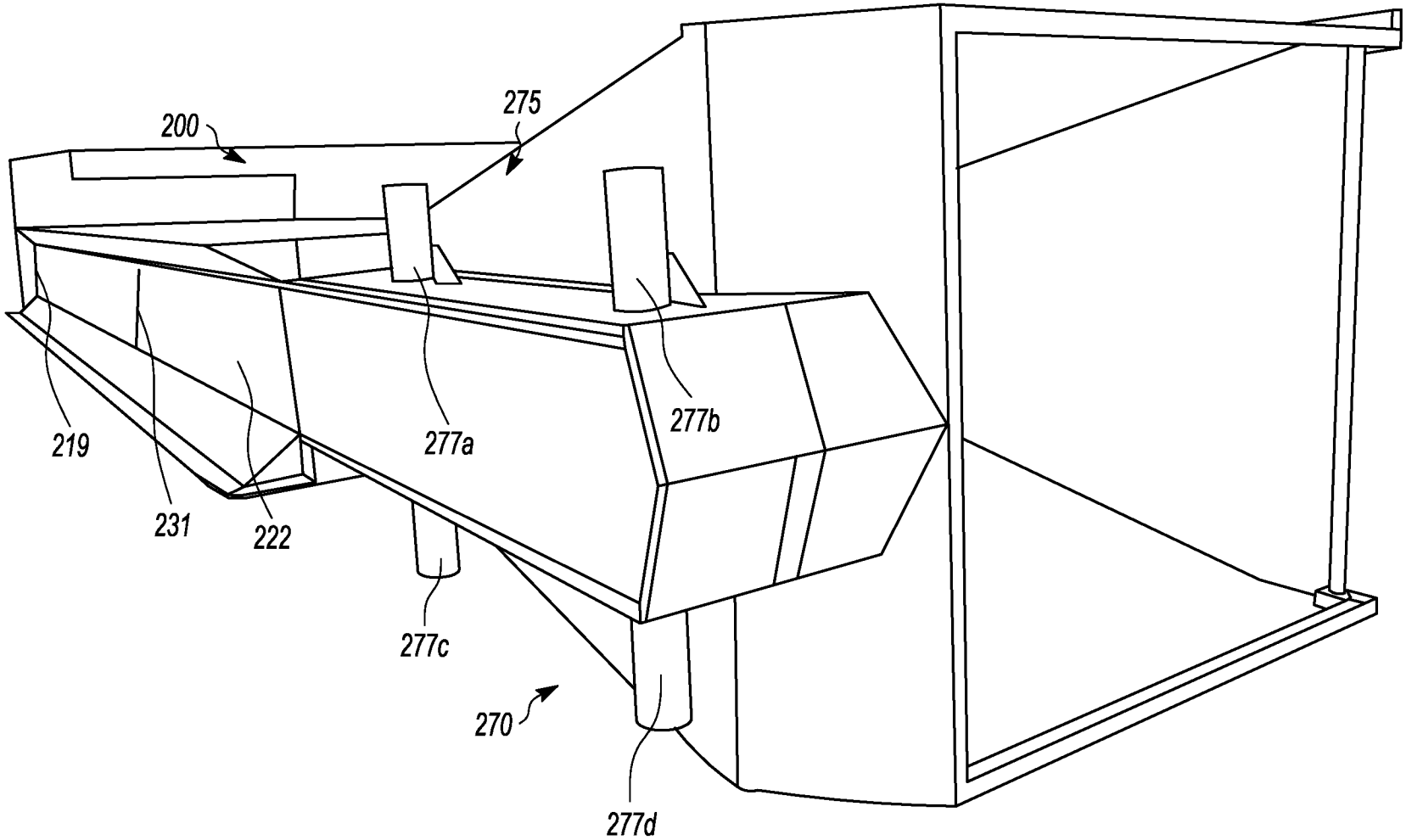
FIG. 3 illustrates an isometric back view of the flexible in-ground shield apparatus shown in FIG. 2, in accordance with at least one embodiment disclosed herein.
Figure 4:
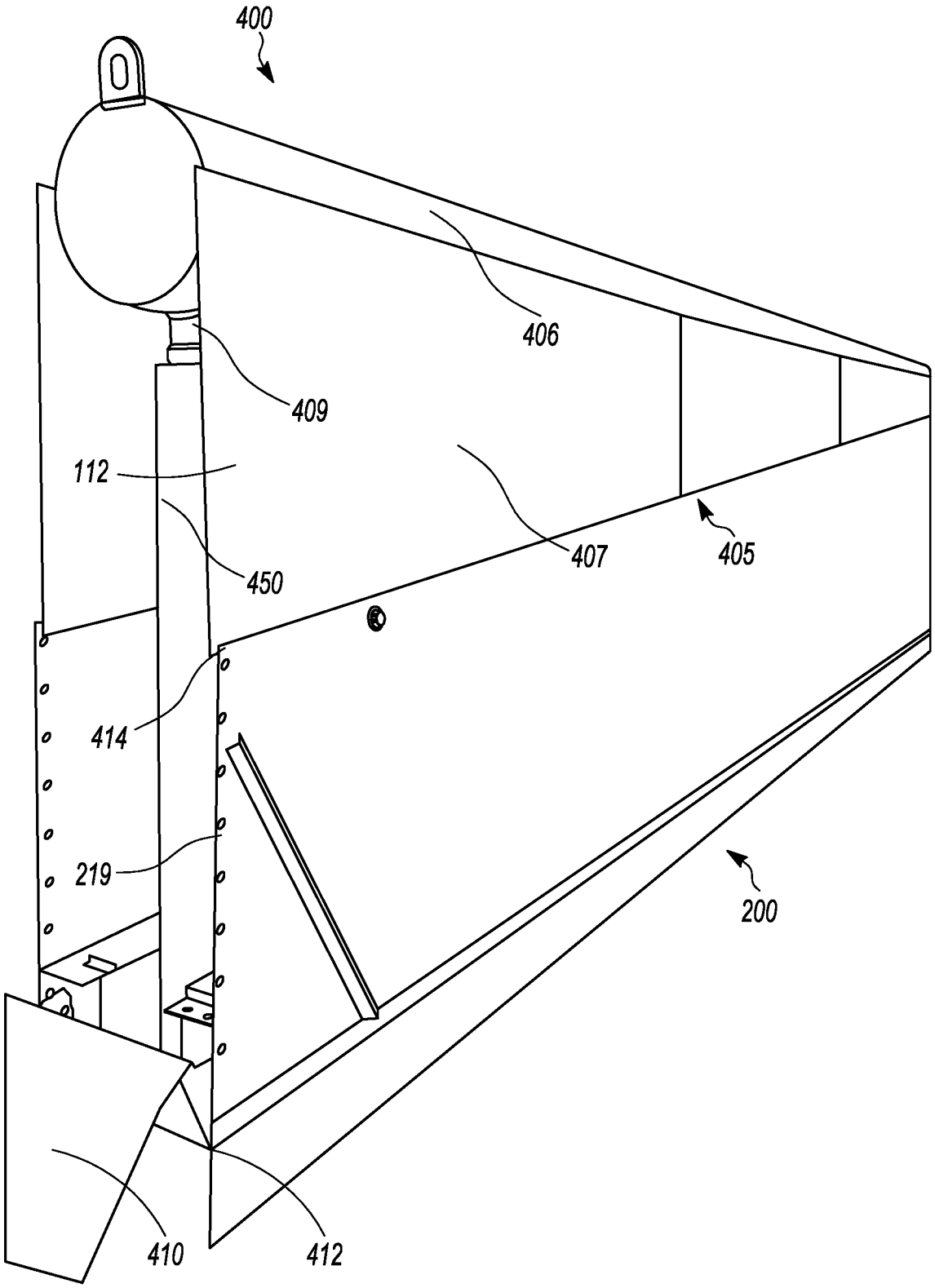
FIG. 4 illustrates an isometric bottom view of the ground excavation shield shown in FIG. 2 coupled to a sump apparatus, in accordance with at least one embodiment disclosed herein.

In at least one embodiment, a hopper can be coupled to the flexible in-ground shield 200, such as a hopper 270, as shown in FIGS. 2, 3, 8 and 8. As shown, the hopper 270 can be fixed (e.g., welded) to the top 218 of the flexible in-ground shield 200. In other embodiments, the hopper 270 can be releasably coupled (e.g., bolted) to the top 218 of the flexible in-ground shield 200. A first wall 272 and a second wall 274 of the hopper 270 are coupled to the first and second walls 212/214 of the flexible in-ground shield 200 at angles such that an area at a top 278 of the hopper 270 is larger than an area at a top 218 of the flexible in-ground shield 200. In at least one embodiment, the hopper 270 includes shoring members 276*a* and 276*b* that are fixed to the first wall 272 and the second wall 274, to at least mitigate deformation of the hopper 270 when filled with the fill material 125. In at least one embodiment, a trencher coupler 275 is disposed proximate to the top 218 of the flexible in-ground shield 200. In the example shown in FIGS. 2 and 3, the trencher coupler 275 includes a plurality of posts 277*a*/277*b*/277*c*/277*d* disposed on a back of the hopper 270, as shown. The trencher coupler 275 couples the flexible in-ground shield 200 to the trencher 860. In at least one other embodiment, the trencher coupler 275 can be coupled to the flexible in-ground shield 200.

In at least one embodiment, the flexible in-ground shield 200 further includes a fill material guide member 280 coupled to the first, second, and third walls 212/214/216. The fill material guide member 280 is angled to taper an area between the third wall 216 and a front 282 of the flexible in-ground shield 200 from a greater area proximate to a top 218 of the flexible in-ground shield 200 to a lesser area proximate to a bottom 219 of the flexible in-ground shield 200. The fill material guide member 280 guides the fill material 125 disposed into the flexible in-ground shield 200 to the lesser area proximate to the bottom 219 of the flexible in-ground shield 200, while also acting as a protective shield for components disposed behind the fill material guide member 280, such as the flexible pipe curved guide 450.

Figure 5:
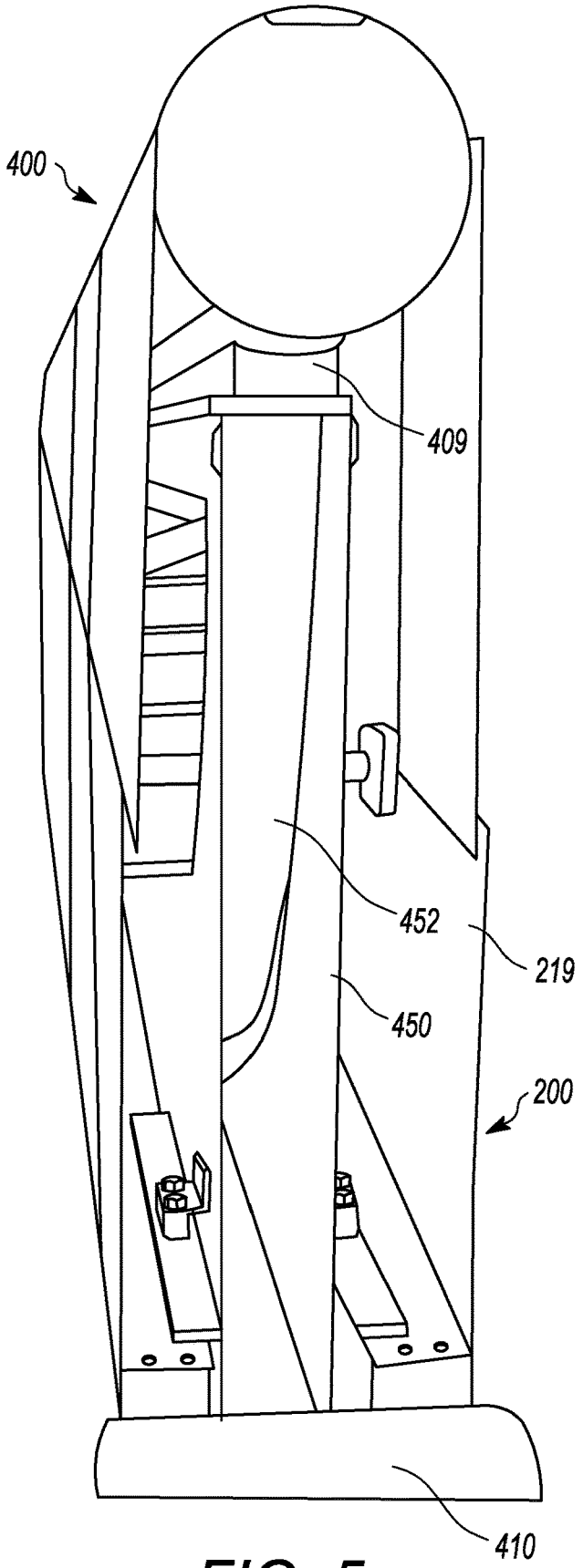
FIG. 5 illustrates another isometric bottom view of the ground excavation shield shown in FIG. 2 coupled to the sump apparatus, in accordance with at least one embodiment disclosed herein.
Figure 7:
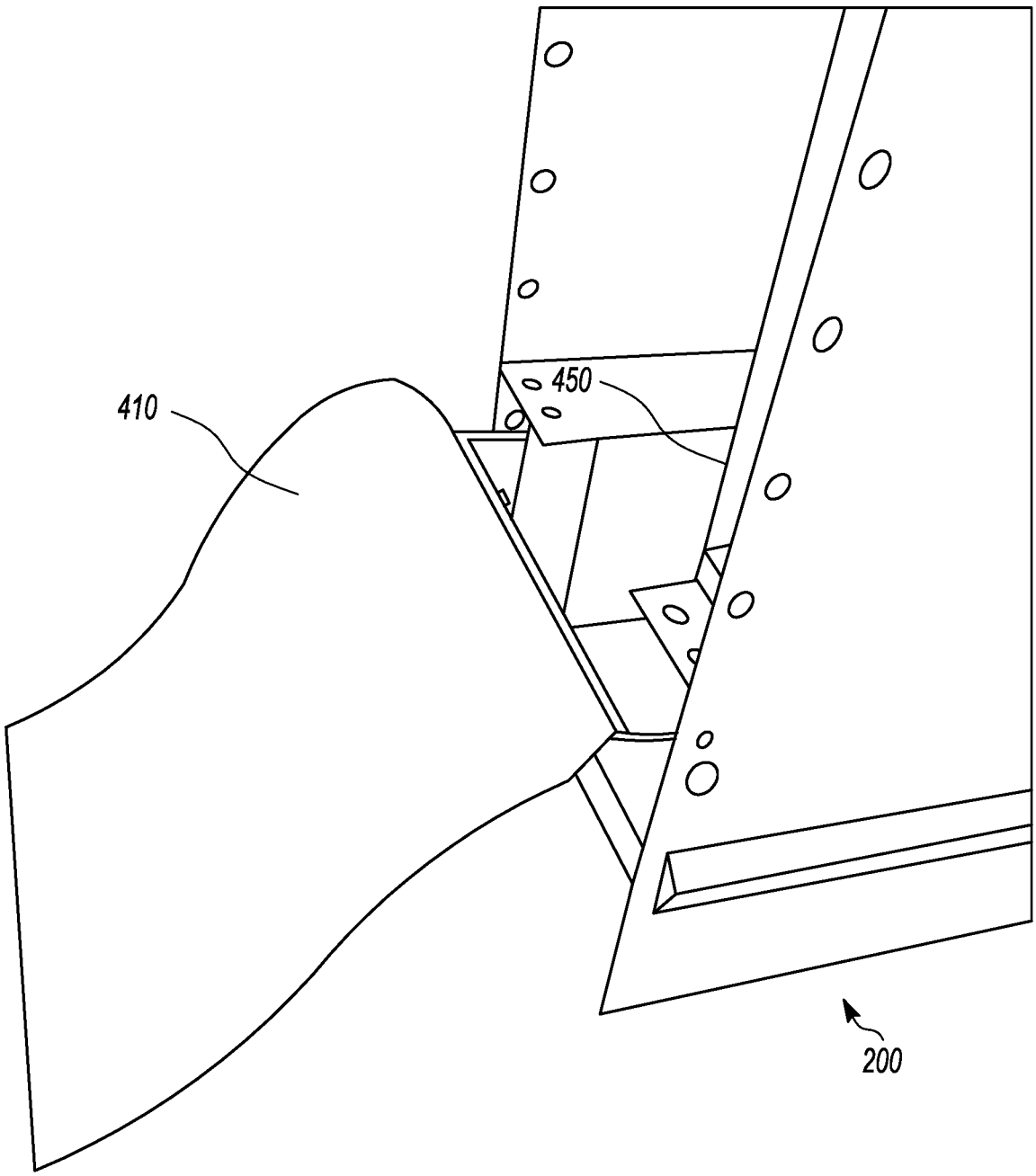
FIG. 7 illustrates another isometric bottom view of the ground excavation shield shown in FIG. 2 including a pivoting flap, in accordance with at least one embodiment disclosed herein.

The flexible in-ground shield 200 includes a leading edge 412 and a trailing edge 414 disposed on the bottom 219 of the flexible in-ground shield 200, the leading edge 412 being closest to the trencher chain 810 (FIG. 8) and being closer to a direction of travel of the flexible in-ground shield 200 during use, as compared to the trailing edge 414. In at least one embodiment, the flexible in-ground shield 200 further includes a pivoting flap 410 (FIGS. 4, 5, and 7). The pivoting flap 410 can be made from a rubber based material to remain pliable during use. The pivoting flap 410, shown as being disposed proximate to the leading edge 412 of the flexible in-ground shield 200, prevents dirt and/or debris from entering the bottom 219 of the flexible in-ground shield 200 proximate to the leading edge 412 during use of the flexible in-ground shield 200.

As shown in FIGS. 4 and 5, a system 400 can include the flexible in-ground shield 200 coupled to a sump apparatus 405 including the sump pipe 406 coupled to an edge of a sump shielding 407. The sump shielding 407 is dimensioned to allow the sump shielding 407 to be disposed between the first and second walls 212/214, as shown. Once the trench 955 is started, the sump apparatus 405 is released from the flexible in-ground shield 200 to drop the sump apparatus 405 into the trench 955, typically at a beginning of the trench 955. In the example shown, a cable 808 can be coupled proximate to the bottom 866 of the sump pipe 406, the cable 808 being used to keep the sump apparatus 405 vertical while disconnecting the cable 808 from the sump apparatus 405 and pull up on the sump apparatus 405 once inserted into the trench 955 to release the sump apparatus 405 from the flexible in-ground shield 200.

The trencher 860 then rolls backward while operating the trencher chain mechanism 890 (FIGS. 8 and 9) to form the trench 955, extending the trench 955 as the trencher 860 continues to move backward. The flexible pipe 865 is coupled to a bottom 866 of the sump pipe 406, such as to the inlet 409 of the sump pipe 406. The flexible pipe 865 extends down the flexible in-ground shield 200 and changes direction at the bottom 219 of the flexible in-ground shield 200 to extend to the bottom 866 of the sump pipe 406. As the trencher 860 moves backward, the flexible pipe 865 is continuously fed into the trench 955, to lay the flexible pipe 865 at a bottom of the trench 865. In at least one embodiment, with reference to FIGS. 8 and 9, another system 800 is shown that can include the flexible in-ground shield 200 coupled to a trencher 860.

In at least one embodiment, the flexible in-ground shield 200 can receive the fill material 125 via a conveyor 870 (FIGS. 8 and 9) coupled to the trencher 860. In the example shown, the conveyor 870 is an over-head conveyor that is disposed over-top of the trencher 860, angled to extend from a back of the trencher 860 to an area above the hopper 270. The fill material 125 can be disposed into a rear hopper 880 (FIGS. 8 and 9) coupled to a rear of the trencher 860, as shown. The fill material 125 can moving from the rear hopper 880 to the hopper 270. Furthermore, in at least one embodiment the flexible in-ground shield 200 further includes a release post 885, disposed on at least one of the first and second walls 212/214, to couple the flexible in-ground shield 220 to the trencher chain mechanism 890, including at least a trencher chain 892 and a trencher chain support member 894, via a release hook 895.

For example, this trencher 860 can be of the type developed by DeWind Corporation. The trencher 860 can be of the type that uses one-pass trenching technology, such as model MT2000 or MT3500. These trenchers install various types of systems deeper, faster, safer, and at less cost than most conventional alternatives. The MT 3500 (e.g., with up to 3,500 horse power) can reach depths of up to 125' feet below grade for "Mix In Place" walls, such as soil Bentonite Walls, soil cement Bentonite wall installations, and the sump apparatus 405, discussed above. In some instances, the trencher 860 utilizes the in-ground flexible shield(s) 100/200 to install in-ground systems.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A flexible in-ground shield, comprising:

a first wall disposed on a first side of the flexible in-ground shield;

a second wall disposed on a second side of the flexible in-ground shield;

a third wall disposed on a third side of the flexible in-ground shield and coupled to the first and second walls to define a trough extending from a top end to a bottom end of the flexible in-ground shield;

a plurality of shoring members extending between the first wall and the second wall; and a plurality of pivoting couplers, each pivoting coupler pivotably coupling an end of one of the shoring members to one of either the first and second walls, respectively, to allow the first wall and the second wall to pivot relative to the third wall;

wherein the plurality of pivoting couplers are at least one of a hinge joint, a ball and socket joint, a condyloid joint, or a saddle joint;

and wherein the flexible in-ground shield is structurally configured to be coupled to a trencher during trenching and to direct fill material longitudinally from the top end of the in-ground shield into a trench formed by the trencher.

2. The flexible in-ground shield according to claim 1, further comprising a pivoting flap, disposed on a leading edge of the bottom end of the flexible in-ground shield, to prevent dirt from entering the flexible in-ground shield at the leading edge during use.

3. The flexible in-ground shield according to claim 1, wherein the first and second walls taper from a greater width proximate the top end of the flexible in-ground shield to a lesser width proximate to the bottom end of the flexible in-ground shield.

4. The flexible in-ground shield according to claim 1, wherein the top end of the flexible in-ground shield receives the fill material via a conveyor coupled to the trencher.

5. The flexible in-ground shield according to claim 1, wherein the fill material is disposed into a rear hopper coupled to a rear of the trencher and is transported via a conveyor to the top end of the flexible in-ground shield.

6. The flexible in-ground shield according to claim 1, further comprising a flexible pipe tubular guide, disposed between the first, second, and third walls, to guide a flexible pipe toward the bottom end of the flexible in-ground shield.

7. The flexible in-ground shield according to claim 1, further comprising a release post, disposed on at least one of the first and second walls, to couple the flexible in-ground shield to a trencher chain mechanism via a release hook.

8. The flexible in-ground shield according to claim 1, further comprising a fill material guide member coupled to the first, second, and third walls, the fill material guide member angled to taper an area between the third wall and a front of the flexible in-ground shield from a greater area proximate to the top end of the flexible in-ground shield to a lesser area proximate to the bottom end of the flexible in-ground shield, the fill material guide member guiding a fill material disposed into the flexible in-ground shield to the lesser area.

9. The flexible in-ground shield according to claim 1, further comprising a trencher coupler disposed proximate to the top end of the flexible in-ground shield, the trencher coupler coupling the flexible in-ground shield to a trencher.

10. The flexible in-ground shield according to claim 1, wherein the third wall is recessively coupled to the first and second walls to form a channel therebetween, the channel being disposed on a back of the flexible in-ground shield.

11. The flexible in-ground shield according to claim 1, further comprising a flexible pipe curved guide including a curved surface to redirect a direction of travel of a flexible pipe.

12. A system including the flexible in-ground shield according to claim 1, the system further comprising a trencher.

13. A system including the flexible in-ground shield according to claim 1, the system further comprising a sump apparatus, the sump apparatus including a sump shielding dimensioned to allow the sump shielding to be disposed between the first and second walls.

14. The system including the flexible in-ground shield according to claim 13, wherein a cable is coupled proximate to a bottom of the sump apparatus and is used to release the sump apparatus from the flexible in-ground shield.

15. The flexible in-ground shield according to claim 1, further comprising a hopper coupled to the top end of the flexible in-ground shield.

* * * * *